US005305288A

United States Patent [19]

Kupiszewski et al.

[11] Patent Number: 5,305,288

[45] Date of Patent: Apr. 19, 1994

[54] VARIABLE RELUCTANCE ACOUSTIC PROJECTOR

[75] Inventors: Thomas Kupiszewski, Harrison City; David Marschik, Murrysville, both of Pa.

[73] Assignee: Westinghouse Electric Corp., Pittsburgh, Pa.

[21] Appl. No.: 54,184

[22] Filed: Apr. 30, 1993

[51] Int. Cl.[5] ..... H04R 23/00

[52] U.S. Cl. ..... 367/175; 367/182; 381/192; 381/194; 381/199

[58] Field of Search ..... 367/175, 182, 185; 381/192, 194, 197, 199, 200, 201, 202

[56] References Cited

U.S. PATENT DOCUMENTS

| | | | |
|---|---|---|---|
| 3,671,684 | 6/1972 | Tibbetts et al. | 179/117 |
| 3,691,515 | 12/1972 | Pida | 340/8 R |
| 3,725,856 | 4/1973 | Chervenak | 340/8 R |
| 3,990,034 | 11/1976 | Abbott | 181/113 |
| 4,000,381 | 12/1976 | Plice et al. | 179/114 M |
| 4,208,736 | 6/1980 | Babikyan | 367/153 |
| 4,387,451 | 6/1983 | Wilcox | 367/142 |
| 4,690,004 | 9/1987 | Tavis | 73/862.64 |
| 4,845,450 | 7/1989 | Porzio et al. | 310/26 |
| 5,126,979 | 6/1992 | Rowe, Jr. et al. | 367/175 |
| 5,206,839 | 4/1993 | Murray | 367/175 |

*Primary Examiner*—J. Woodrow Eldred
*Attorney, Agent, or Firm*—D. Schron

[57] ABSTRACT

A variable reluctance acoustic projector includes a piston structure that provides rigid retention and precise alignment of electromagnetic cores within the projector housing. The piston structure provides a pair of metallic piston blocks having cavities in which the electromagnetic cores are mounted. The piston blocks rigidly retain the electromagnetic cores within the cavities by compressive loading, improving the structural reliability of the device. In addition, the piston blocks enable precise alignment and orientation of the pole faces of opposing electromagnetic cores parallel to one another. Flexure ribs formed in the piston blocks increase the compliance of the blocks to substantially confine motion of the piston blocks to translation along a single axis of actuation during excitation of the electromagnetic cores.

16 Claims, 3 Drawing Sheets

VARIABLE RELUCTANCE ACOUSTIC PROJECTOR

BACKGROUND OF THE INVENTION

1. Field of the Invention

The present invention relates to acoustic signal generation systems. More particularly, the present invention relates to a variable reluctance acoustic projector for use in underwater sonar applications.

2. Description of Related Art

Variable reluctance transducers (VRT) represent one of several technologies used to generate acoustic signals in surveillance and tactical sonar arrays. A variable reluctance transducer typically includes an electromagnetic device having a movable core mounted in a housing opposite a substantially fixed core. In response to excitation of the fixed core via coil windings, the movable core is deflected, actuating a projector diaphragm to generate an acoustic signal.

When variable reluctance transducers are used to actuate an acoustic projector for sonar applications, it is necessary to ensure both precise alignment of opposing electromagnetic cores and rigid attachment of one or both cores to portions of the water tight housing containing the cores. Precise alignment of the electromagnetic cores is important for two reasons.

First, the electrical inductance of the projector varies with the width of the air gap between the opposing cores. If air gap dimensions fall out of tolerance due to core misalignment, the resulting variance in the air gap, which may amount to a significant percentage of the nominal uniform air gap thickness, can cause the actual electrical response characteristic of the electromagnetic transducer to substantially differ from the desired response.

Second, core misalignment may produce an actuation thrust vector that does not coincide with the acoustic axis of the projector, resulting in a distorted beam pattern. This condition may occur if the pole faces of opposing cores are not sufficiently parallel, or if they are shifted horizontally relative to one other. In such a case, unwanted signal harmonics may be produced.

Rigid attachment of the cores to the housing is necessary to avoid undesirable shunting of acoustic energy away from the outgoing acoustic beam. Furthermore, both precise core alignment and rigid attachment must be maintained for stringent dynamic operation conditions to enable the sonar transducer to withstand explosive shock specifications.

Existing VRT structures fail to provide adequate alignment and sufficiently rigid attachment of the electromagnetic cores within the acoustic projector housing. As a result, conventional VRT sonar arrays are susceptible to the problems discussed above.

SUMMARY OF THE INVENTION

In view of the foregoing, the present invention provides a variable reluctance acoustic projector having a piston structure that enables rigid core retention and precise core alignment within the acoustic projector housing.

Additional advantages of the invention will be set forth in part in the description which follows, and in part will be obvious from the description, or may be learned by practice of the invention. The objects and advantages of the invention will be realized and attained by means of the elements and combinations particularly pointed out in the written description and claims, as well as the appended drawings.

In accordance with the purpose of the invention, as embodied and broadly described herein, the present invention is a variable reluctance acoustic projector comprising a first metallic piston block including a first cavity, a second metallic piston block including a second cavity, a pair of electromagnetic cores including a first electromagnetic core positioned in the first cavity and a second electromagnetic core positioned in the second cavity, wherein the first piston block is coupled to the second piston block such that a pole face of the first electromagnetic core is aligned with a pole face of the second electromagnetic core, the respective pole faces being oriented substantially parallel to each other and being separated by an air gap of a predetermined width.

It is to be understood that both the foregoing general description and the following detailed description are exemplary and explanatory only and are not restrictive of the invention, as claimed.

The accompanying drawings, which are incorporated in and constitute a part of this specification, illustrate various embodiments of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
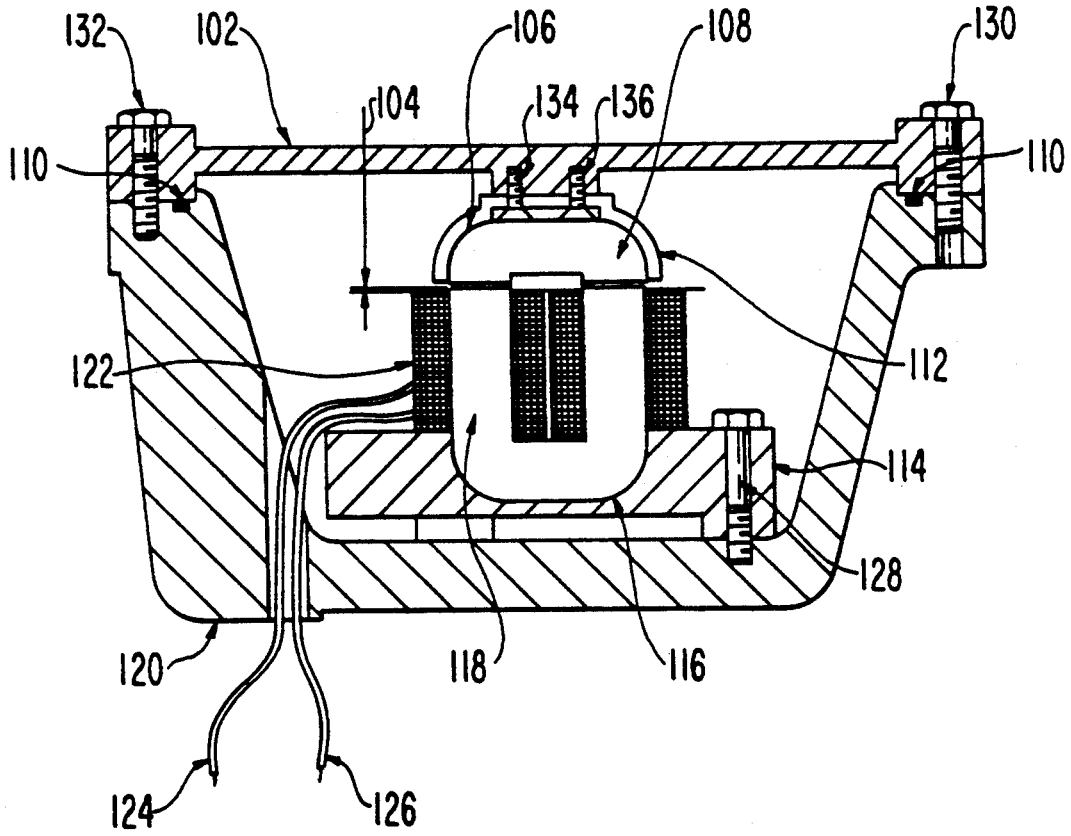
FIG. 1 (PRIOR ART)
FIG. 1 is an example of a prior art variable reluctance acoustic projector constructed according to conventional core alignment and attachment techniques.

FIG. 1 is an example of a VRT acoustic projector constructed according to typical prior art VRT alignment and attachment techniques. FIG. 1 presents an illustration of the problems inherent in the prior art VRT device, relative to the present invention.

As shown in FIG. 1, the prior art acoustic projector comprises a movable electromagnetic core 108 and a fixed electromagnetic core 118 having pole faces disposed opposite one another within a projector housing 120. An air gap 104 separates the opposing pole faces of electromagnetic cores 108 and 118. According to the prior art technique, the movable electromagnetic core 108 is attached by cement 106 to core holder 112, which is coupled by bolts 134, 136 to a diaphragm 102. The fixed electromagnetic core is similarly attached by cement 116 to core holder 114, which is connected to the housing 120 by bolt 128. Bolts 130 and 132 connect the diaphragm 102 and housing 120, and the entire assembly is sealed with an O-ring seal 110.

Upon excitation of coil winding 122 via wires 124 and 126, the fixed electromagnetic core 118 generates an electromotive force that acts to displace movable electromagnetic core 108 relative to the housing 120, thereby actuating diaphragm 102 to produce an acoustic signal. However, because the center of mass of the movable core 108 is far removed from the center of mass of the diaphragm 102, the resultant beam pattern produced by the prior art device may be undesirably distorted.

For example, during deflection, the weight of the moving core 108 imparts an unbalanced moment to the diaphragm 102 at times when the diaphragm 102 is not oriented orthogonal to gravity. Consequently, for most projector orientations, the pole faces of the movable core 108 and the fixed core 118 cannot be maintained parallel to one another. This results in a net actuation force that is not perpendicular to the diaphragm 102, thereby causing a degradation of signal output.

In addition, according to the prior art structure, the cores 108, 118 are attached to the respective core holders 112, 114 only by cement-type joints 106, 116. Such cement-type joints have a high criticality, but provide low structural reliability. For instance, all of the sinusoidal actuation force generated during core excitation is transferred through the cement regions 106, 116 in tension during every half cycle. However, the epoxy-type bonds typically used for cement regions 106, 116 have very poor reliability for tensile loading, and are easily fractured. Furthermore, such epoxy-type bonds exhibit a brittleness that is a primary cause of material failure due to impulsive loading, such as that experienced during explosive shock conditions.

According to the present invention, there is provided a variable reluctance acoustic projector comprising a first metallic piston block including a first cavity, a second metallic piston block including a second cavity, and a pair of electromagnetic cores including a first electromagnetic core positioned in the first cavity and a second electromagnetic core positioned in the second cavity. The piston structure of the present invention eliminates the disadvantages associated with the prior art VRT structure, ensuring both precise alignment and rigid retention of the electromagnetic cores within the projector housing.

Figure 2:
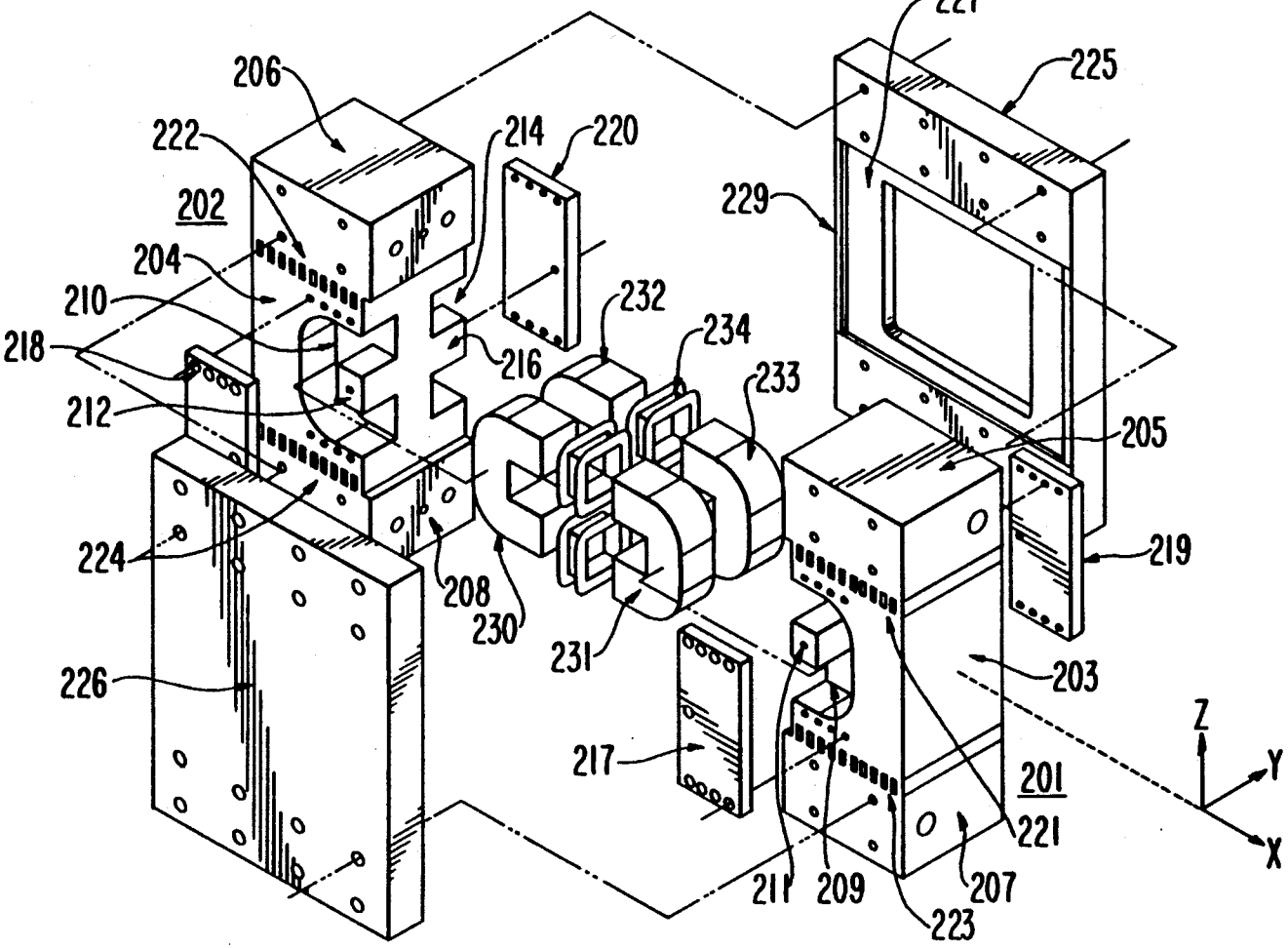
FIG. 2 is an exploded view of the variable reluctance acoustic projector of the present invention.

As herein embodied and shown in FIG. 2, the projector assembly includes a set of metallic piston blocks 201, 202 configured to house opposing sets of electromagnetic cores. In response to actuation of the piston blocks 201, 202, the exterior sides of the piston blocks serve as acoustic radiation surfaces, generating acoustic signals for sonar applications. Piston blocks 201, 202 are machined from metal to form blocks of substantially the same size and shape. Each piston block can be machined from a monolithic block of metal. Alternatively, each piston block can be formed by combining two or more metal blocks and machining the resultant block, or by joining two or more premachined blocks. The use of a monolithic metal block is preferable for formation of piston blocks 201, 202. However, when the fabrication of large piston blocks is required, the combination of two or more smaller blocks may be desirable to facilitate the use of stock-sized materials.

The piston blocks 201, 202 should be formed of nonferromagnetic metal having a high strength-to-weight ratio and long fatigue life. Low carbon steel alloy and iron are examples of materials that are not considered suitable. Preferred materials for fabrication of the piston blocks are, for example, stainless steel, such as cold-worked A-286, titanium alloys, or aluminum alloys.

Each of the monolithic, metallic piston blocks 201, 202 includes a piston section, acting as the principal acoustic radiator section, and two end sections. Piston block 201 comprises a piston section 203 disposed between an end section 205 and an end section 207. Similarly, piston block 202 has a piston section 204, end section 206, and end section 208.

The projector includes a first and second pair of opposing electromagnetic cores 230, 231, and 232, 233 for actuating the piston sections 203, 204 of piston blocks 201, 202. Each of the electromagnetic cores 230, 231, 232, 233 is formed of a laminated electromagnetic material and can be constructed, for example, as a tape-wound "C" or "E"-shaped core or as a stack of "C" or "E"-shaped stampings.

The piston section of each metallic piston block 201, 202 includes a pair of cavities, having a shape substantially conforming to the shape of the electromagnetic cores, for rigidly retaining the electromagnetic cores 230, 231, 232, 233. Cavities 210, 214, milled into piston section 204 of piston block 202, hold electromagnetic cores 230 and 232, respectively. FIG. 2 shows one cavity 209 of the two cavities milled into piston section 203 of piston block 201 for retention of cores 231 and 233.

Cavities 210, 214 include front openings directed outward through a front plane of the piston block 202. Each cavity 210, 214 includes a rectangular mounting post 212, 216 designed to hold cores 230, 232 within the corresponding cavity of piston block 202 with respect to motion along an axis X of block deflection, oriented perpendicular to the front surface plane of the piston block. Like piston block 202, piston block 201 includes a rectangular mounting post 211 for holding core 231 within cavity 209. Another rectangular mounting post (not shown) is provided for retention of core 233 within the other cavity (not shown) in piston block 201.

The projector further provides means for compressively loading the electromagnetic cores 230, 231, 232, 233 against the respective piston blocks 201, 202 to rigidly retain the cores within the milled cavities 209, 210, 214, and the cavity not shown in FIG. 2. For example, The cavities 209, 210, 214, and the cavity not shown in FIG. 2 include side openings directed outward through adjacent side surface planes of the piston blocks 201, 202. Core retainer plates 218, 220 are bolted to the sides of piston block 202 and to the rectangular mounting posts 212, 216, to compressively load the 230, 232 against the interior surface of piston block 202 within the respective cavities 210, 214. Core retainer plates 218, 220 also serve to reduce the compliance of the piston section 204 in the region adjacent the cavities 210, 214. Core retainer plates 217, 219 compressively load electromagnetic cores 231, 233 against the interior surfaces of piston block 201 within the cavities. To interrupt the circulation of induced eddy currents flowing within the piston block 202, the core retainer plates 217, 218, 219, 220 can be made from a structural grade insulating material such as, for example, G10 or phenolic.

Figure 3:
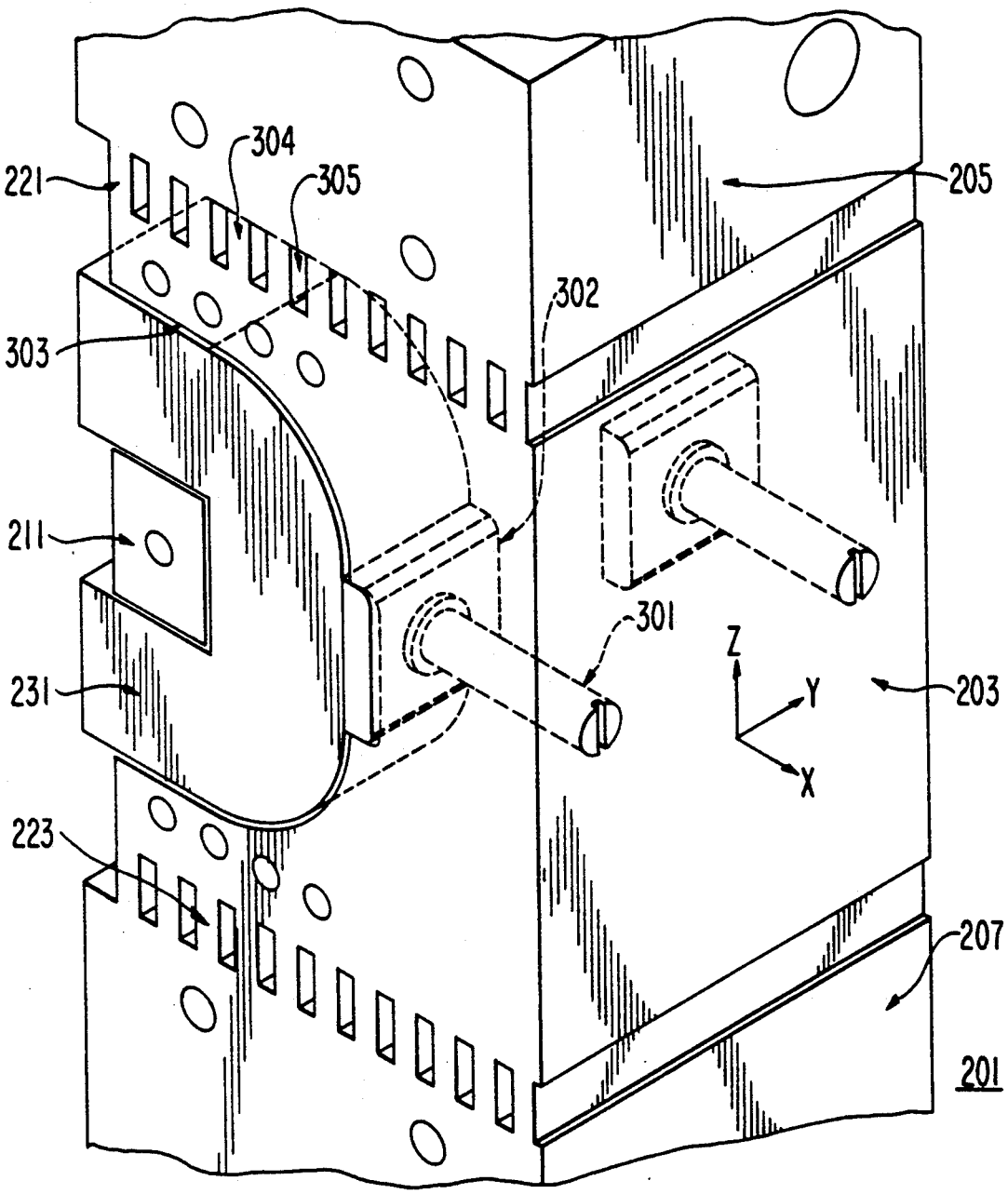
FIG. 3 is a partial view of the variable reluctance acoustic projector shown in FIG. 2, illustrating core alignment and attachment according to the piston structure of the present invention.

FIG. 3 illustrates another feature of the compressive loading means provided by the projector. For example, to position the core 231 within piston block 201, the core 231 is first shimmed into a desired alignment position within the cavity 209 defined by the rectangular mounting post 211 and a milled interior wall of piston section 203. Threaded rod 301 is then torqued against bearing pad 302 to compressively load the core 231 against the rectangular mounting post 211. This rod and bearing pad arrangement is provided for each of the cavities.

To maintain rigid coupling of the actuating force generated by the electromagnetic cores to the piston section 203, the compressive preloading imparted to the core 231 via rod 301 and bearing pad 302 must be set to exceed the maximum dynamic force acting on the core in the X direction during actuation. In addition, the dimensions of the rectangular mounting post 211 should be selected such that its compliance is less than the combined compliance of the flexure ribs 221, 223 formed between piston section 203 and end sections 205 and 207, respectively.

Thus, electromagnetic core 231 is sandwiched between a high modulus, cantilevered, monolithic buttress block, defined by the rectangular mounting post 211, and the high modulus bearing pad 302. The resulting structure ensures that virtually the entire actuation force acting on the pole faces of cores 231 and 233 is transferred directly to the radiating piston sections 203, 204 only through stiff metal alloy parts. Accordingly, the structural reliability of the piston structure is greatly improved relative to the cement-type joints used in the prior art VRT device.

The piston blocks 201, 202 are pinned and bolted together such that the pole faces of opposing cores 230, 231 and 232, 233 are aligned and oriented parallel to one another, and are separated by a uniform air gap. Winding bobbins 234, associated with excitation coils (not shown) wound about the electromagnetic cores 230, 231, 232, 233, surround the air gaps and protruding portions of the cores. The projector assembly is completed by bolting cover plates 225, 226 to the sides of the piston blocks 201, 202.

Each cover plate 225, 226 is bolted to respective sides of piston block 201 at end sections 205 and 207, and to respective sides of piston block 202 at end sections 206 and 208. The cover plates 225, 226 include milled recesses, such as that indicated by region 227 in cover plate 225, providing a clearance ledge 229 to accommodate core retainer plates 217, 218, 219, and 220.

Upon excitation of the coil windings (not shown), deflection of the opposing electromagnetic cores 230, 231 and 232, 233 relative to one another actuates the piston blocks 201, 202 to generate an acoustic signal that is transmitted from the exterior sides of the piston sections 203, 204. To avoid shorting the electromagnetic circuit between the core pairs, the piston blocks must be machined to provide an air gap between opposing pole faces that exceeds the maximum net piston block deflection in the direction X during core excitation. In addition, to maintain rigid coupling, the piston blocks 201, 202 must be bolted together with a bolt preload setting in excess of the maximum inertial loading associated with deflection of the piston blocks 201, 202 in the X direction.

The entire projector assembly can be sealed by applying an elastomeric, saltwater compatible adhesive between the adjacent surfaces of the piston blocks 201, 202, as well as between each of the piston blocks and the cover plates 225, 226. The adhesive can also be applied to the clearance ledges around the milled recess provided in each of the cover plates 225, 226.

To prevent significant damping of piston block vibration, the separation between the clearance ledges of the cover plates 225, 226 and the piston blocks 201, 202 should be much larger than the maximum piston block deflection in the X direction during core excitation. For example, if maximum piston block deflection is 0.0001 inches, a sufficient thickness of the elastomer adhesive layer applied between the piston blocks 201, 202 and the clearance ledges of the cover plates 225, 226 would be approximately 0.01 inches.

Piston blocks 201, 202 also include sets of flexure ribs formed in the piston blocks at mechanical junctions defining the piston section and respective end sections. For instance, as shown in FIG. 2, piston block 201 includes a plurality of flexure ribs 221 formed between piston section 203 and end section 205, and a plurality of flexure ribs 223 formed between piston section 203 and end section 207. Similarly, flexure ribs 222, 224 are formed in piston block 202 at a position between piston section 204 and end section 206, and at a position between piston section 204 and end section 208.

As shown in FIG. 3, with respect to piston block 201, each plurality of flexure ribs includes a plurality of individual ribs 304 defined by a plurality of spaced rectangular bores 305 formed in the piston block along the X axis, corresponding to the axis of block deflection during actuation. The longitudinal, or Y-, axis of each rectangular bore 305 is oriented parallel to the longitudinal axis of the piston block 201. The rectangular bores 305 extend through the entire width of the piston block 201, and can be readily formed by, for example, wire electric discharge machining.

The incorporation of flexure rib sets 221, 222, 223, and 224 ensures that motion of the piston blocks 201, 202 is confined only to translation along the X axis of block deflection. Specifically, the size and mass of piston blocks 201, 202 are selected, given particular acoustic performance specifications, to produce a compliance along the X axis (the axis of piston block deflection) that is orders of magnitude greater than compliance along the orthogonal Y and Z axes.

The particular number and dimensions of the bores 305 defining the flexure ribs can then be selected to control the compliant characteristics of the piston blocks 201, 202, such that motion of the piston blocks 201, 202 is confined only to translation in the X direction. The flexure ribs 221, 222, 223, 224, formed in piston blocks 201 and 202, virtually eliminate significant rigid body rotation of the piston blocks due to torques and moments about the X, Y, or Z axis. As a result, the beam pattern source level and signal fidelity of the VRT acoustic projector of the present invention are not affected by the orientation of the projector relative to gravity.

A low modulus encapsulating material 303, such as high durometer rubber, for example, can be added to impregnate the void spaces in the cavity 208 surrounding the core 231. The use of an encapsulating material may be desirable for various reasons. For example, such an encapsulating material would prevent delamination of a tape-wound core due to thermal stress resulting from core losses. In addition, the encapsulating material would damp core noise produced by magnetostriction. Finally, cooling of the electromagnetic core could be enhanced by the extra heat conduction path provided by the encapsulating material between the core and the piston block.

The general procedure for determining the dimensions of the flexure ribs 221, 222, 223, 224, given a requirement for generating acoustic signals at a specific, in-water resonance frequency, fc, will now be discussed. This discussion assumes that both piston blocks 201, 202 are baffled by sonar array structure in which the acoustic projector is mounted, and that the height and width dimensions of the rectangular radiating surfaces of piston blocks 201, 202, as well as the dimensions of the rectangular mounting posts 211, 212, 216, the mounting post not shown in FIG. 2, the electromagnetic cores 230, 231, 232, 233, the core cavities 209, 210, 214, the cavity not shown in FIG. 2, the coil bobbins 234, and the core retainer plates 217, 218, 219, 220, are predetermined.

First, the wavenumber k is calculated according to the resonance, or center, frequency, fc. The resistive and reactive components of the acoustic radiation impedance are then calculated for each piston block 201, 202 by substituting the dimensions of the respective radiating face and the wavenumber k into the mathematical expressions and tables provided in the text *Theoretical Acoustics,* by P. M. Morse and K. U. Ingard. Dividing the reactive component of the radiation impedance by the center frequency, fc, in units of radians per second, the effective water mass per piston block 201, 202 is obtained.

To calculate the projector motional mass per piston, for each of the piston blocks 201, 202, the volume and density products of the moving projector components are summed. For piston block 201, with reference to FIG. 2, it is necessary to sum the volume and density products associated with piston section 203, rectangular mounting post 211, the mounting post not shown in FIG. 2, core retainer plates 217, 219, electromagnetic cores 231, 233, coil bobbins 234, and any fasteners used to attach the core retainer plates 217, 219 to piston section 203, mounting post 211, and the mounting post not shown in FIG. 2, respectively.

Similarly, to determine the projector motional mass for piston block 202, the volume and density products must be summed for piston section 204, rectangular mounting posts 212, 216, core retainer plates 218, 220, electromagnetic cores 230, 232, coil bobbins 234, and any fasteners used to attach the core retainer plates 218, 220 to piston section 204 and mounting posts 212, 216, respectively.

With reference to FIG. 3, volume and density products should also be determined for threaded rods 301 and 302. Because the inertia associated with displacement of the flexure ribs 221, 222, 223, 224 is negligible compared with the inertia of the other components in the projector assembly, it can be ignored. In addition, the projector motional mass can be approximated by neglecting the contributions of all the components other than the piston sections 203, 204, the mounting posts 211, 212, 216, the mounting post not shown in FIG. 2, and the electromagnetic cores 230, 231, 232, 233.

The total motional mass per piston is calculated by summing the effective water mass per piston and the projector motional mass per piston. The effective mechanical stiffness, Kblock, of each of the piston blocks 201, 202 is estimated in units of force per distance per piston block, along the X-axis direction shown in FIG. 2. For low frequencies ($ka<1$ and/or $kb<1$), the effective mechanical stiffness can be estimated by treating each piston block 201, 202 as an undamped, one degree of freedom, lumped mass-spring oscillator. The stiffness, or spring rate, is then approximated as the product of the total motional mass per piston times the square of the center frequency, fc, expressed in units of radians per second. The required stiffness per flexure rib, Krib, is calculated as Krib=Kblock/Nrib where Nrib is the total number of flexure ribs per piston block 201, 202.

The flexure ribs 221, 222, 223, 224 function essentially as a multi-beam support in which each beam possesses a rectangular cross-section and clamped-clamped end conditions. With reference to piston block 202, for example, the Z-axis distance separating piston section 204 from end section 206, or from end section 208, corresponds to the beam span L. The beam width W is measured along the Y-axis shown in FIG. 2 and must be less than or equal to the width of the piston section 203, 204. The beam thickness, h, is measured along the X-axis. The required flexure rib stiffness, Krib, is achieved by any combination of rib dimensions such that $$Krib=12EIyc/(L^3),$$

where E is the Young's modulus of the flexure rib material and Iyc is the area moment of inertia about the principal axis of the flexure rib, parallel to the global Y-axis shown in FIG. 2. The area moment of inertia is represented by $$Iyc=(1/12)Wh^3,$$

where W is the beam width and h is the beam thickness, as indicated above. These formulas are based upon the mathematical expressions provided in *Formulas for Natural Frequency and Mode Shape* by Robert D. Blevins, Ph.D. It is noted that the choice of dimensions W, h, and L is further constrained by the condition that the in-water resonance bending stress developed in each flexure rib due to maximum deflection of the piston must be less than the yield stress for the flexure rib material. The margin between the bending stress and the yield stress will be determined by the required cyclic fatigue life which must exceed the design operating life requirement of the device.

The piston structure of the VRT acoustic projector of the present invention provides several advantages over the prior art VRT device. For example, in the prior art VRT structure, actuation force is transferred in tension to structurally unreliable cement-type joints during every other half cycle of core excitation. According to the piston structure of the present invention, however, actuation forces are coupled only by rigid metal.

In addition, the acoustic beam pattern generated by the prior art VRT device may be undesirably affected by the orientation of the device relative to gravity. The piston structure of the present invention incorporates flexure ribs between the radiating piston sections and associated end sections that provide additional compliance to substantially confine the motion of the piston block to translation along a single axis of block deflection.

The monolithic, bolted block design of the present invention also enables ready size scaling by modular construction, facilitating construction of large, high power surveillance arrays, and also enhances the survivability of the device during shock conditions.

Having described the presently preferred embodiments of the invention, additional advantages and modifications will readily occur to those skilled in the art from consideration of the specification and practice of the invention disclosed herein. It is intended that the specification and examples be considered as exemplary only, with a true scope and spirit of the invention being indicated by the following claims.

We claim:

1. A variable reluctance acoustic projector comprising:

a first metallic piston block including a first cavity;

a second metallic piston block including a second cavity;

a pair of electromagnetic cores including a first electromagnetic core positioned in said first cavity and a second electromagnetic core positioned in said second cavity, wherein said first piston block is coupled to said second piston block such that a pole face of said first electromagnetic core is aligned with a pole face of said second electromagnetic core, the respective pole faces being oriented substantially parallel to each other and being separated by an air gap of a predetermined width.

2. The variable reluctance acoustic projector of claim 1, further comprising:

means for compressively loading said first electromagnetic core against said first piston block to rigidly retain said first electromagnetic core within said first cavity, and for compressively loading said second electromagnetic core against said second piston block to rigidly retain said second electromagnetic core within said second cavity.

3. The variable reluctance acoustic projector of claim 2, wherein said first piston block includes a first mounting post disposed within said first cavity, said second piston block includes a second mounting post disposed within said second cavity, and said means for compressively loading includes:

means for compressively loading said first electromagnetic core against said first mounting post; and means for compressively loading said second electromagnetic core against said second mounting post.

4. The variable reluctance acoustic projector of claim 3, wherein said first cavity includes a side opening in a side surface of said first piston block, said second cavity includes a side opening in a side surface of said second piston block, and said means for compressively loading further includes:

a first core retainer plate covering at least a portion of said side opening in said first piston block, said first core retainer plate compressively loading said first electromagnetic core against an interior surface of said first cavity; and a second core retainer plate covering at least a portion of said side opening in said second piston block, said second core retainer plate compressively loading said second electromagnetic core against an interior surface of said second cavity.

5. The variable reluctance acoustic projector of claim 4, wherein each of said first and second core retainer plates comprises an insulating material for interrupting induced eddy currents circulating in said first and second piston blocks.

6. The variable reluctance acoustic projector of claim 1, wherein said first piston block includes a first piston section in which said first cavity is formed, a first end section oriented adjacent a top area of said first piston section, and a second end section oriented adjacent a bottom area of said first piston section, and wherein said second piston block includes a second piston section in which said second cavity is formed, a third end section oriented adjacent a top area of said second piston section, and a fourth end section oriented adjacent a bottom area of said second piston section, said first and second piston blocks further comprising:

a plurality of first bores formed in said first piston block at a position between said first end section and said first piston section, said first bores extending through said first piston block to form a plurality of first flexure ribs, each of said first flexure ribs being defined by adjacent ones of said first bores;

a plurality of second bores formed in said first piston block at a position between said second end section and said first piston section, said second bores extending through said first piston block to form a plurality of second flexure ribs, each of said second flexure ribs being defined by adjacent ones of said second bores;

a plurality of third bores formed in said second piston block at a position between said third end section and said second piston section, said third bores extending through said second piston block to form a plurality of third flexure ribs, each of said third flexure ribs being defined by adjacent ones of said third bores; and a plurality of fourth bores formed in said second piston block at a position between said fourth end section and said second piston section, said fourth bores extending through said second piston block to form a plurality of fourth flexure ribs, each of said fourth flexure ribs being defined by adjacent ones of said fourth bores.

7. The variable reluctance acoustic projector of claim 6, wherein each of said first and second piston blocks has a compliance along an axis perpendicular to each of said pole faces that is greater than a compliance along axes parallel to said pole faces, said flexure ribs substantially eliminating rotation of said first and second piston blocks in response to force along said perpendicular axis such that motion of said piston blocks is substantially confined to translation along said perpendicular axis.

8. The variable reluctance acoustic projector of claim 7, wherein said first mounting post has a compliance that is less than a combined compliance of all of the flexure ribs formed in said first piston block, and said second mounting post has a compliance that is less than a combined compliance of all of the flexure ribs formed in the second piston block.

9. The variable reluctance acoustic projector of claim 1, wherein said first piston block includes a third cavity and said second piston block includes a fourth cavity, said variable reluctance acoustic projector further comprising:

a second pair of electromagnetic cores including a third electromagnetic core positioned in said third cavity and a fourth electromagnetic core positioned in said fourth cavity.

10. The variable reluctance acoustic projector of claim 9, further comprising:

a first cover plate covering a first side surface of said first piston block and a first side surface of said second piston block; and a second cover plate covering a second side surface of said first piston block opposing said first side surface of said first piston block and a second side surface of said second piston block opposing said first side surface of said second piston block.

11. The variable reluctance acoustic projector of claim 1, wherein each of said first and second piston blocks comprises a non-ferromagnetic metal.

12. The variable reluctance acoustic projector of claim 11, wherein said non-ferromagnetic metal is stainless steel.

13. The variable reluctance acoustic projector of claim 11, wherein said non-ferromagnetic metal is a titanium alloy.

14. The variable reluctance acoustic projector of claim 11, wherein said non-ferromagnetic metal is an aluminum alloy.

15. The variable reluctance acoustic projector of claim 1, wherein each of said first and second cavities includes an encapsulating material filling void spaces between said first and second electromagnetic cores and interior surfaces of said first and second cavities.

16. The variable reluctance acoustic projector of claim 1, wherein each of said first and second electromagnetic cores and each of said first and second cavities is substantially C-shaped, and each of said first and second electromagnetic cores includes two pole faces.

* * * * *